United States Patent [19]

Blickle

[11] Patent Number: 4,932,916

[45] Date of Patent: Jun. 12, 1990

[54] TOY BUILDING COMPONENT WITH A CONNECTING LUG

[75] Inventor: Eugen Blickle, Durrweiler, Fed. Rep. of Germany

[73] Assignee: Fischerwerke Artur Fischer GmbH & Co. KG, Waldachtal/Tumlingen, Fed. Rep. of Germany

[21] Appl. No.: 324,595

[22] Filed: Mar. 15, 1989

[30] Foreign Application Priority Data

Mar. 24, 1988 [DE] Fed. Rep. of Germany ..... 3809922

[51] Int. Cl.[5] ..... A63H 33/08; A63H 33/04

[52] U.S. Cl. ..... 446/124; 446/127; 446/85

[58] Field of Search ..... 446/124, 123, 122, 121, 446/120, 104, 127, 85, 86, 105, 106, 107, 108, 111, 118

[56] References Cited

U.S. PATENT DOCUMENTS

| | | | |
|---|---|---|---|
| 2,885,822 | 5/1959 | Onanian | 446/122 X |
| 3,811,219 | 5/1974 | Fischer | 446/107 |
| 4,551,110 | 11/1985 | Selvage et al. | 446/122 X |
| 4,764,143 | 8/1988 | Gat et al. | 446/120 X |

FOREIGN PATENT DOCUMENTS

| | | | |
|---|---|---|---|
| 228357 | 4/1959 | Fed. Rep. of Germany . | |
| 404572 | 6/1961 | Fed. Rep. of Germany . | |
| 1400852.7-12 | 10/1963 | Fed. Rep. of Germany . | |
| 2056230.5 | 11/1970 | Fed. Rep. of Germany . | |
| 2056230 | 5/1972 | Fed. Rep. of Germany | 446/127 |
| 2510334 | 9/1976 | Fed. Rep. of Germany | 446/121 |
| 7701786 | 7/1978 | Fed. Rep. of Germany . | |
| 360742 | 3/1973 | U.S.S.R. | 446/123 |
| 415250 | 8/1934 | United Kingdom | 446/123 |

*Primary Examiner*—Robert A. Hafer
*Assistant Examiner*—D. Neal Muir
*Attorney, Agent, or Firm*—Michael J. Striker

[57] ABSTRACT

A toy building component having a connecting lug projecting from an end face of the toy building component and insertable into a matching opening of an adjacent toy building component for joining the two components together; and at least one raised portion located on the outer face of the toy building component from which the connecting lug projects to be snapped into the matching opening for fixedly joining the two components.

9 Claims, 1 Drawing Sheet

FIG. 1
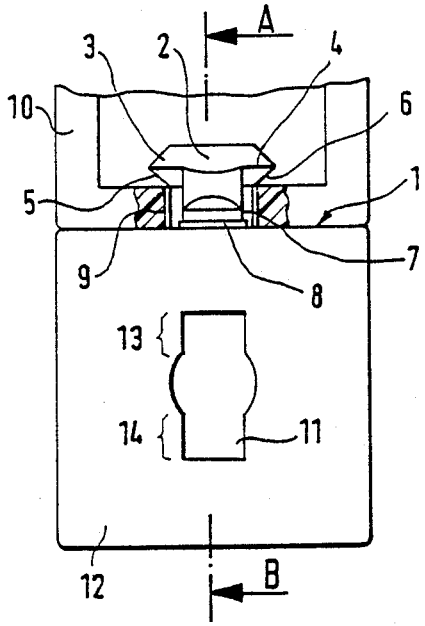
FIG. 2
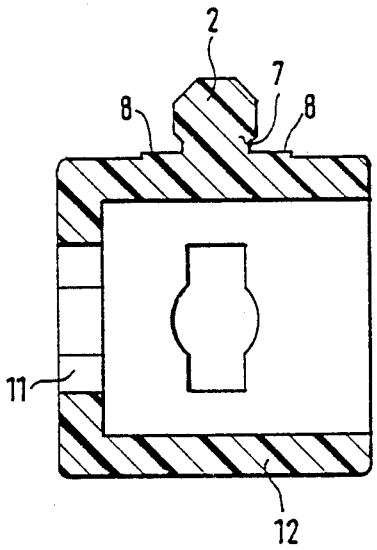
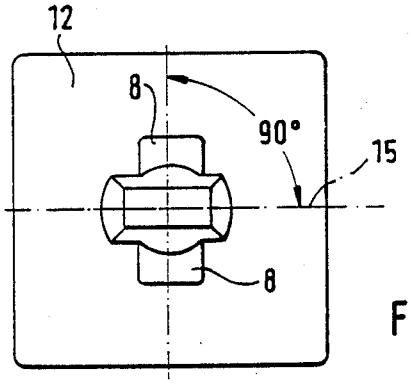
FIG. 3

TOY BUILDING COMPONENT WITH A CONNECTING LUG

BACKGROUND OF THE INVENTION

The invention relates to a toy building component with a connecting lug.

DE-OS 20 56 230 discloses a toy building component which is a building block of a toy building kit. This known toy building component has on one end face a connecting lug, which can be inserted in a substantially rectangular opening of an adjacent building component and can be locked by being turned through 90°. The toy building component itself also has two such openings on two of its longitudinal sides, into which a connecting lug can be inserted. The connecting lug has oppositely located projections at its projecting end which safeguard the connecting lug from slipping out of the opening once it has been inserted in an elongate opening and turned through 90°.

The length of the shank to the root of the projections can be slightly smaller than the wall thickness, in the region of this opening, of an adjacent component to which the shank is to be attached in order to achieve a certain clamping effect. Such a clamping effect can be achieved in particular in toy building blocks made of plastic materials due to the resilient nature thereof, but this clamping effect frequently provides too little security against accidental twisting.

SUMMARY OF THE INVENTION

The object of the invention is to provide means for preventing rotation of toy building components in the region of their connecting lugs.

The object of the invention is achieved by providing in a toy building component of the kind mentioned above, a raised portion projecting slightly at the outer surface close to the connecting lug. The raised portion releasably engages with a snap-fit an opening of an adjacent component and prevents rotation of the component relative to the adjacent component. The opening extends laterally of the shank, which is of substantially circular cross-section, so that once the connecting lug has been turned through 90°, the raised portion engages free region of the opening. The raised portion has preferably a shape which matches the shape of the free region of the opening. The raised portion thus fits exactly into the free region of the opening and forms suitably effective means for preventing rotation.

Preferably two raised portions are arranged symmetrically on opposite sides of the shank, but other kinds of raised portions are also suitable. Rotation is effectively prevented with the raised portion projecting by 0.2 to 0.4 mm with respect to the outer surface of the toy building component.

The projections, which give the connecting lug a T-shape, preferably merge into the shank and are connected thereto by inclined surfaces. The inclined surface has the advantage that the desired clamping effect between the connecting lug and the adjacent component takes place at the root of the inclined surface and, thus, any existing manufacturing tolerances pose fewer problems in view of the action of clamping forces.

The present invention as to its construction so to its method of operation, together with additional objects and advantages thereof, will be best understood from the following description of the preferred embodiment with reference to the accompanying drawings.

BRIEF DESCRIPTION OF THE DRAWINGS

FIG. 1 shows a side view of a toy building component with a connecting lug according to the present invention and engaging an adjacent component;

FIG. 2 shows a longitudinal sectional view along the section line A-B of the toy building component with a connecting lug illustrated in FIG. 1; and FIG. 3 shows a plan view of the toy building component with a connecting lug illustrated in FIG. 1.

DESCRIPTION OF THE PREFERRED EMBODIMENTS

A toy building component 12 illustrated in FIG. 1 has on its upper outer face 1 a connecting lug 2 extending perpendicular thereto and having lateral projections 3, 4. The lateral projections 3, 4 merge into a shank 7, the cross-section of which is substantially circular. Inclined faces 5, 6 connect the lateral projection 3 and 4 with the shank 7.

On the outer face 1 on each side of the shank 7, there is formed a shallow raised portion 8 which extends into an elongate opening 9 of an adjacent toy building component 10. The opening 9 is of the same shape as an opening 11 provided on the visible end face of the toy building component 12.

In FIG. 2, which shows the cross-section of the toy building component 12 along the section line A-B, the integrally moulded raised portion 8 on both sides of the shank 7 can be seen.

The plan view according to FIG. 3 shows that the raised portion 8 is a rectangular area which corresponds to the outline of the openings 9, 11. The raised portion thus engages exactly the free open region of the opening 9 extending laterally of the shank 7 and which corresponds to open regions 13, 14 of the opening 11.

The position of the shallow raised portions 8 is displaced by 90° with respect to the longitudinal axis 15, which forms a center line common to the projections 3, 4. Only when the connecting lug 2 has been inserted into an opening 9 and has been subsequently rotated through 90°, the portions 8 snap into the regions 13, 14.

While the invention has been illustrated and described with respect to a preferred embodiment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A toy building component to be connected with an adjacent toy building component and comprising a body having an outer face; a connecting lug projecting from said outer face and insertable in an opening in the adjacent toy building component, said connecting lug having a shank having an end, opposite projections located at said end of said shank, and a longitudinal axis extending parallel to said outer face and through said opposite projections; and at least one substantially rectangular-shaped raised portion of uniform height located on and integral with said outer face adjacent to said shank and having an axis extending parallel to said outer face and displaced by 90° with respect to the longitudinal axis of said connecting lug.

2. A toy building component according to claim 1 further comprising a second raised portion located adjacent said shank and opposite said one raised portion.

3. A toy building component according to claim 2 wherein said one and second raised portions project by 0.2 and 0.4 mm above said outer face.

4. A toy building component according to claim 1 wherein said at least one raised portion has an outline matching an outline of an opening portion of the opening in the adjacent toy building component, for receiving said raised portion.

5. A toy building component according to claim 4 wherein said shank has a length equal to the distance between said outer face and said projections, said length being at most equal to a thickness of a wall of the adjacent component in which the opening for receiving said connecting lug is formed.

6. A toy building component according to claim 1 further comprising inclined surfaces for connecting said projections with said shank.

7. A toy building component according to claim 1 wherein said body and said connecting lug are injection-molded parts.

8. A toy kit comprising a first kit building component including an outer face and a connecting lug projecting from said outer face and having a longitudinal axis extending parallel to said outer face, and a shank; a second toy building component connectable with said first toy building component and having a first opening portion for receiving said shank of said connecting lug of said first toy building component; and means for preventing rotation of said first and second toy building components relative to each other, said rotation-preventing means comprising a substantially rectangular-shaped raised portion of uniform height formed on and integral with said outer face of said first toy building component adjacent to said shank and having an axis extending parallel to said outer face and displaced by 90° relative to the longitudinal axis of said connecting lug, and a second substantially rectangular-shaped opening portion in said second toy building component located adjacent said first opening portion for receiving said substantially rectangular-shaped raised portion.

9. A toy kit according to claim 8 wherein said raised portion and said second opening portion have matching outlines.

* * * * *